United States Patent [19]

Martt

[11] 4,010,081

[45] Mar. 1, 1977

[54] APPARATUS FOR QUENCHING AND COOLING COKE

[75] Inventor: Judson W. Martt, Amsterdam, Ohio

[73] Assignee: National Steel Corporation, Pittsburgh, Pa.

[22] Filed: Mar. 14, 1975

[21] Appl. No.: 558,353

[52] U.S. Cl. ..... 202/228; 23/286; 202/230; 202/263; 214/18 K; 214/21; 259/89

[51] Int. Cl.[2] ..... C10B 39/04; C10B 39/10; C10B 39/12

[58] Field of Search ..... 202/227, 228, 229, 230, 202/262, 263, 265; 259/3, 89, DIG. 24; 214/18 K, 21; 23/286; 201/39

[56] References Cited

UNITED STATES PATENTS

| | | | |
|---|---|---|---|
| 1,458,357 | 6/1923 | Postel | 202/227 X |
| 1,487,836 | 3/1924 | Brown | 202/262 |
| 2,413,094 | 12/1946 | Yost | 259/3 |
| 2,998,307 | 8/1961 | Walker | 23/286 X |
| 3,342,467 | 9/1967 | Stirling | 214/21 X |
| 3,367,844 | 2/1968 | Cremer | 202/227 |
| 3,780,888 | 12/1973 | Hoffman | 202/227 X |
| 3,896,556 | 7/1975 | Welter | 202/227 X |

*Primary Examiner*—Norman Yudkoff
*Assistant Examiner*—B. Hollander
*Attorney, Agent, or Firm*—Shanley, O'Neil and Baker

[57] ABSTRACT

Substantially horizontal rotary drum system for quenching and cooling coke, the drum having an internal helical conveying vane for moving the coke through the drum upon rotation of the drum, the diameter and the length of the drum and the pitch of the helical vane being such as to convey predetermined amounts of coke through the drum in the time periods required to quench and cool the coke with the drum rotating at speeds which will not cause undue attrition of the coke. Water sprays are arranged at the coke entry end of the drum, screens to drain excess water from the drum are present near the coke delivery end of the drum and a steam exhaust hood closes the coke delivery end of the drum. A conveyor conveys coke away from the coke delivery end of the drum, the hood including enclosure means for the conveyor. The helical vane is tapered through part of a convolution at the coke entry end of the drum to accept the coke without crushing and at the exit end of the drum to smooth out the rate of delivery of the coke to the conveyor. Hopper and spout means deliver the hot coke to the coke entry end of the drum, the point of delivery being adjacent the lowest portion of the drum to prevent the coke from feeding into the drum too rapidly and clogging the drum. The spout slants in the direction of drum rotation to give better control of the rate of feed of the coke into the drum.

13 Claims, 10 Drawing Figures

FIG. 4
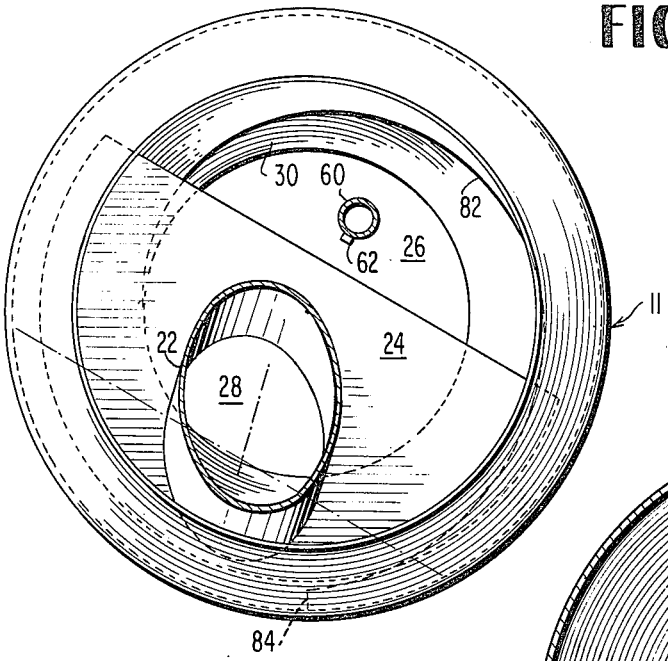
FIG. 5
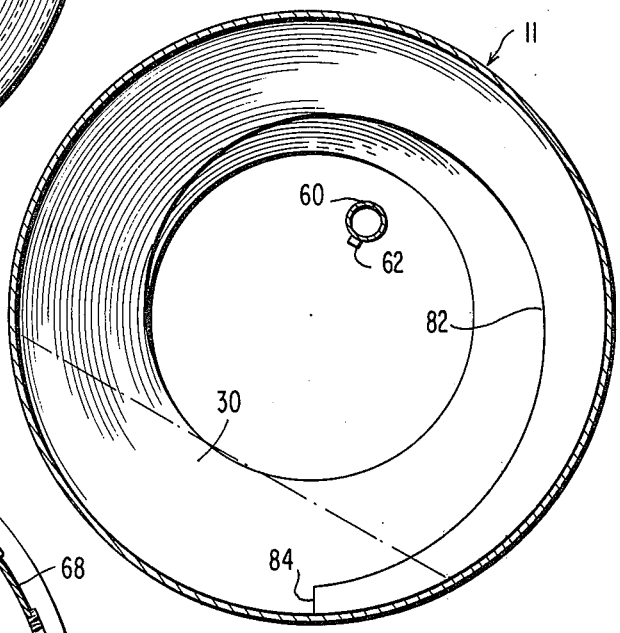
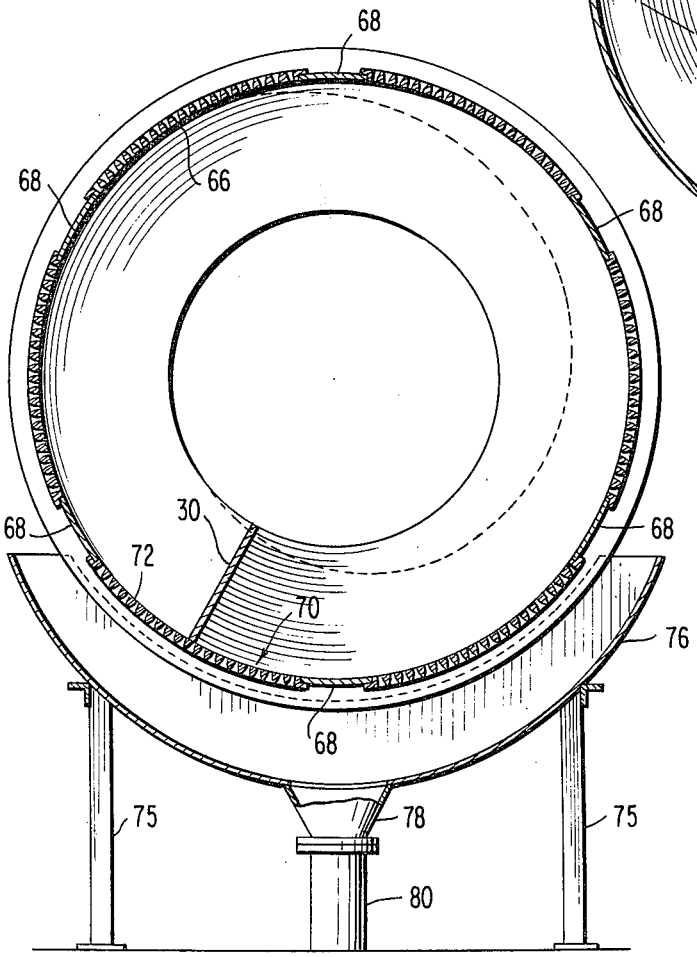
FIG. 9

APPARATUS FOR QUENCHING AND COOLING COKE

BACKGROUND OF THE INVENTION

It has heretofore been proposed to cool and quench hot coke in rotary drums. The prior art systems have involved the use of inclined rotary drums in which it is not practicable for the speed of movement of the coke through the drums to be positively controlled and in which it is not possible for the coke moving through the drums to be thoroughly agitated and mixed so as to receive direct impingement of water sprays on most of the coke surface to quench the coke as rapidly as possible. In addition to the lack of control of the speed of the coke in an inclined drum and the lack of the control of agitation and mixing of the coke during movement through the inclined drum, inclined drums must be of considerable length in order to obtain sufficient dispersal of the coke over an area needed for quenching. More water must be used over a larger area and the coke tends to have excessive moisture content. Long rotating drums are expensive to build and they occupy a greater amount of valuable plant space.

It is an object of the present invention to provide a rotating drum system for quenching and cooling coke in which movement of the coke is positively controlled through the drum in direct relationship to the speed of the drum, thereby permitting the use of a drum of shorter length.

It is a further object of the present invention to provide a rotating drum system for quenching and cooling coke in which the coke has a desired degree of agitation and mixing as it passes through the drum.

It is a further object of the present invention to provide means in a rotating drum for an efficient agitation of the coke which will not cause objectionable attrition of the coke during its passage through the drum.

It ia a further object of the present invention to provide a rotating drum system for quenching and cooling coke which includes efficient means for introducing the coke into the drum and withdrawing coke from the drum.

DESCRIPTION OF THE DRAWINGS

FIG. 4 is a view in section taken on the line 4—4 of FIG. 2;

FIG. 5 is a view in section taken on the line 5—5 of FIG. 2;

FIG. 9 is a view in section taken on the line 9—9 of FIG. 6; and

DESCRIPTION OF THE PREFERRED EMBODIMENT OF THE INVENTION

Figure 1:
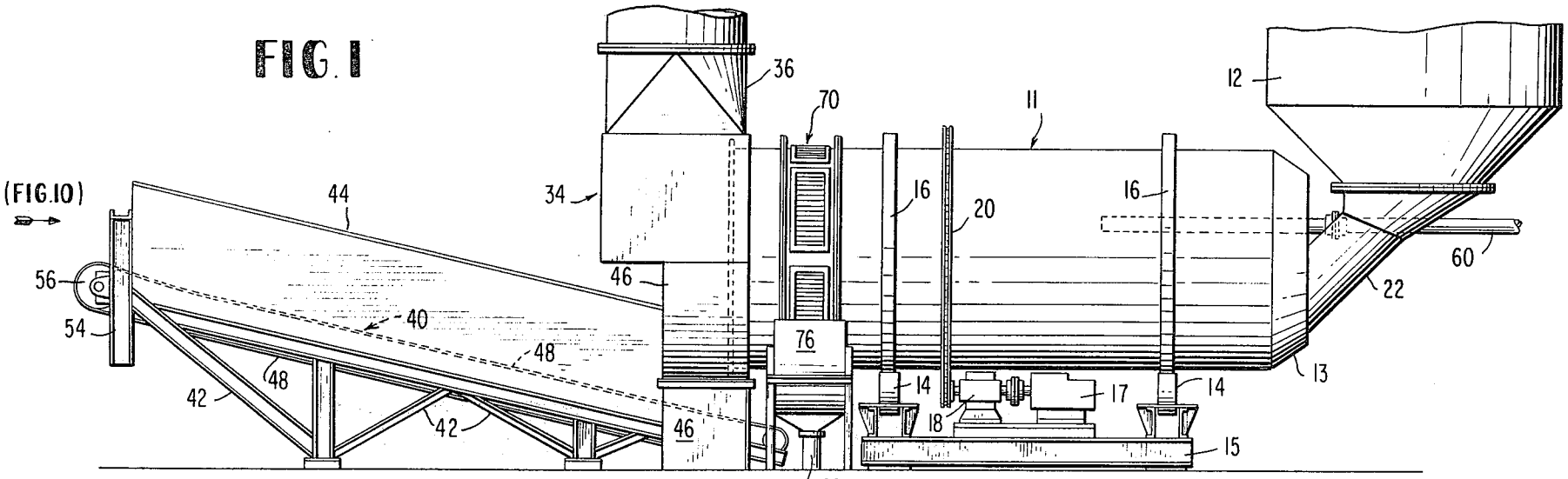
FIG. 1 is a side elevation of a preferred embodiment of the present invention.

In the drawings, reference numeral 11 indicates generally a short, compact rotary drum having a horizontal axis of symmetry, designed to accept and handle efficiently during quenching and cooling a full transfer car load of hot coke which has been dumped in hopper 12. Drum 11 includes at the coke entry end a truncated conical wall 13 for retaining the entering coke within the rotating drum. Drum 11 is supported for rotation about its axis of symmetry on rollers 14, 14 which engage circumferential rails 16, 16 carried by the outer surface of drum 11. Rollers 14, 14 mounted on suitable stationary supporting framework 15 which in turn is ground supported. A conventional motor 17 acting through a conventional gear reduce 18 drives a sprocket and chain assembly 20 for rotating the drum.

Figure 3:
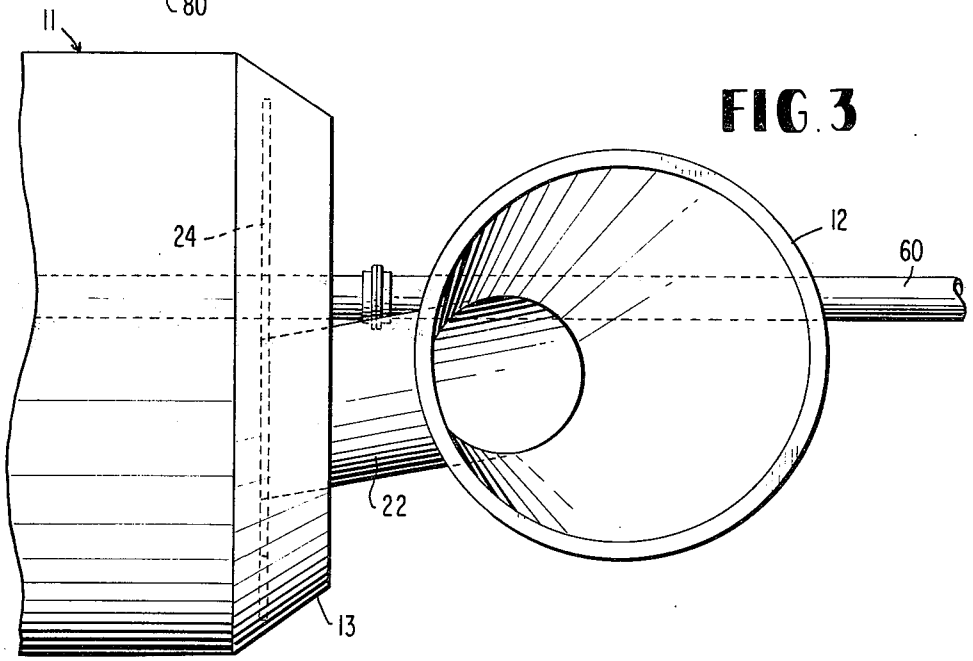
FIG. 3 is a plan view of the structure shown in FIG. 2.
Figure 10:
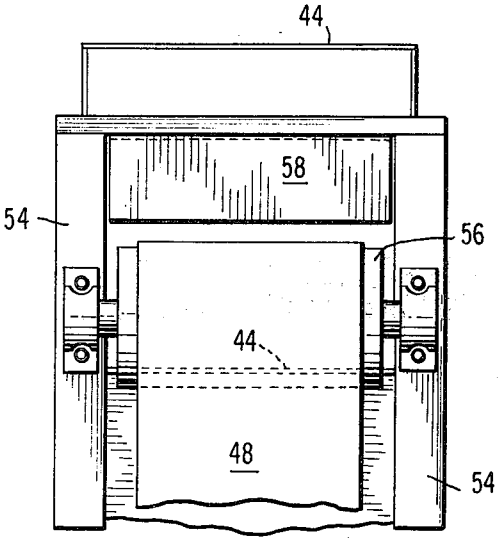
FIG. 10 is a fragmentary, enlarged end elevational view of the coke delivery end of the apparatus with parts omitted for simplicity.
Figure 2:
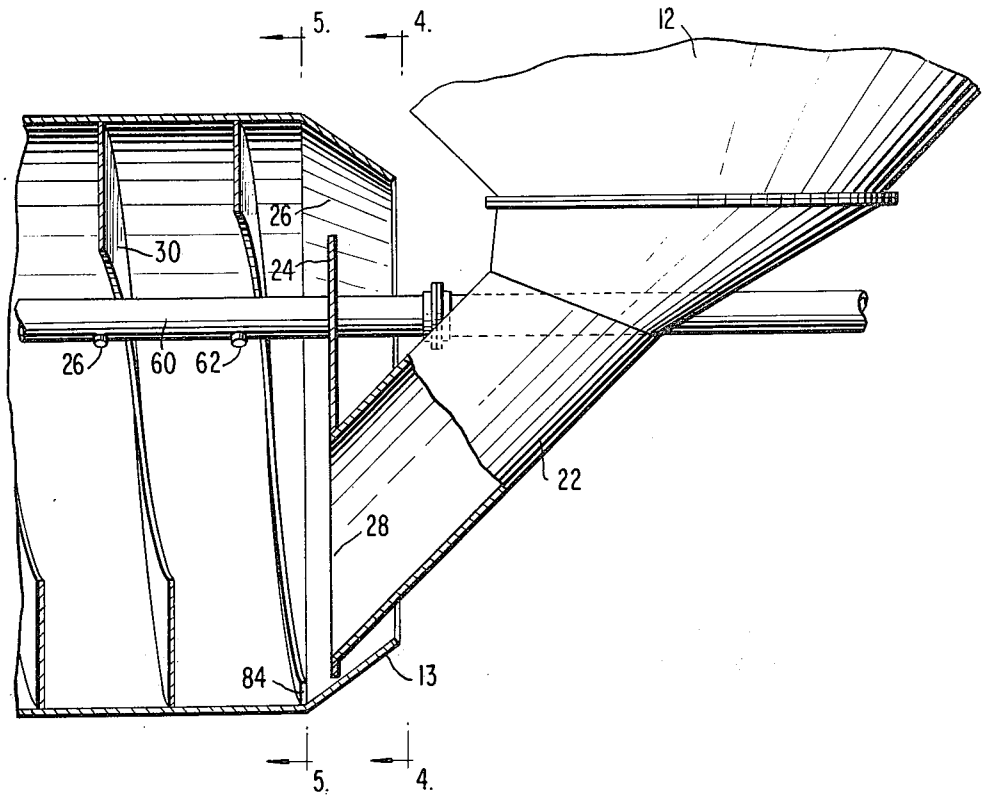
FIG. 2 is a fragmentary, enlarged view in elevation of the apparatus of FIG. 1 at the coke entry end of the drum, with parts broken away better to illustrate the invention.

Hopper 12 feeds the hot coke into the coke entry end of drum 11 through a coke feeding spout 22 which protrudes into the drum and which carries at its lower end a stationary partition or coke restraining means 24 (see FIGS. 2, 3 and 4), the partition serving to close the coke entry end of the drum against the escape of coke while leaving an opening 26 for the ingress of air, as described below. The discharge end of spout 22 is positioned to feed the coke into the drum at a point contiguous to the wall of the rotary drum and at about 7 o'clock circumferentially of the drum. Feed spout 22 is slanted as it approaches its discharge end so as to feed the coke into the drum with a component of motion in the direction of the rotation of the drum. By this arrangement the coke issuing from the discharge end of the spout is moving generally in the same direction as the coke already in the drum which adds an element of control to the feeding action proportional to the speed of rotation of the drum.

Mounted on the cylindrical internal surface of the drum is a single, continuous, helical vane 30 having an inner free edge for moving the entering coke away from the entry end of the drum and through the drum to the coke delivery end of the drum.

At the coke discharge end of the drum, an exhaust hood, indicated generally by the reference numeral 34, surrounds and closes off the discharge end of the drum from the atmosphere. Upper portion 36 of housing 34 constitutes and exhaust duct for steam generated in the drum, which exhaust duct is connected to a suitable blower or exhaust fan. A flange 38 on housing 34 fits around the external cylindrical surface of drum 11 sufficiently close to reduce to a practicable minimum leakage of air at that point into the housing. This sealing need not be gas tight since the subatmospheric exhaust pressure applied to exhaust duct 36 is sufficient to exhaust steam being generated in rotary drum 11 with a practicable amount of leakage at this and other points adjacent the delivery end of drum 11.

A conveyor is indicated generally at 40 for conveying the quenched and cooled coke away from the discharge end of the drum to a point of further handling. Conveyor 40 is supported on a structural framework 42. An enclosure 44 surrounds conveyor 40, enclosure 44 being joined to the lower portion 46 of hood 34 to form in effect a continuation of hood 34 so that the end of the drum and the coke carrying portion of the conveyor belt are enclosed to prevent the free flow of air into the hood 34 and the exhaust system of duct 36. Conveyor belt 48 enters and leaves exhaust hood portion 46 through slots 50 (FIGS. 6 and 7) although if desired hood portion 46 can enclose the lower roll 52 of the conveyor reducing to one the necessary slot at this point. The upper roll 54 of conveyor 40 is supported of framework 42 by a yoke 56. The upper, otherwise open end of enclosure 44 is closed by roll 54 and a flexible curtain 58 which can substantially conform to the shape of the coke being carried by the conveyor to thereby close that end of enclosure 44 against objectionable intake of air into the enclosure by the exhaust system of duct 36.

Figure 8:
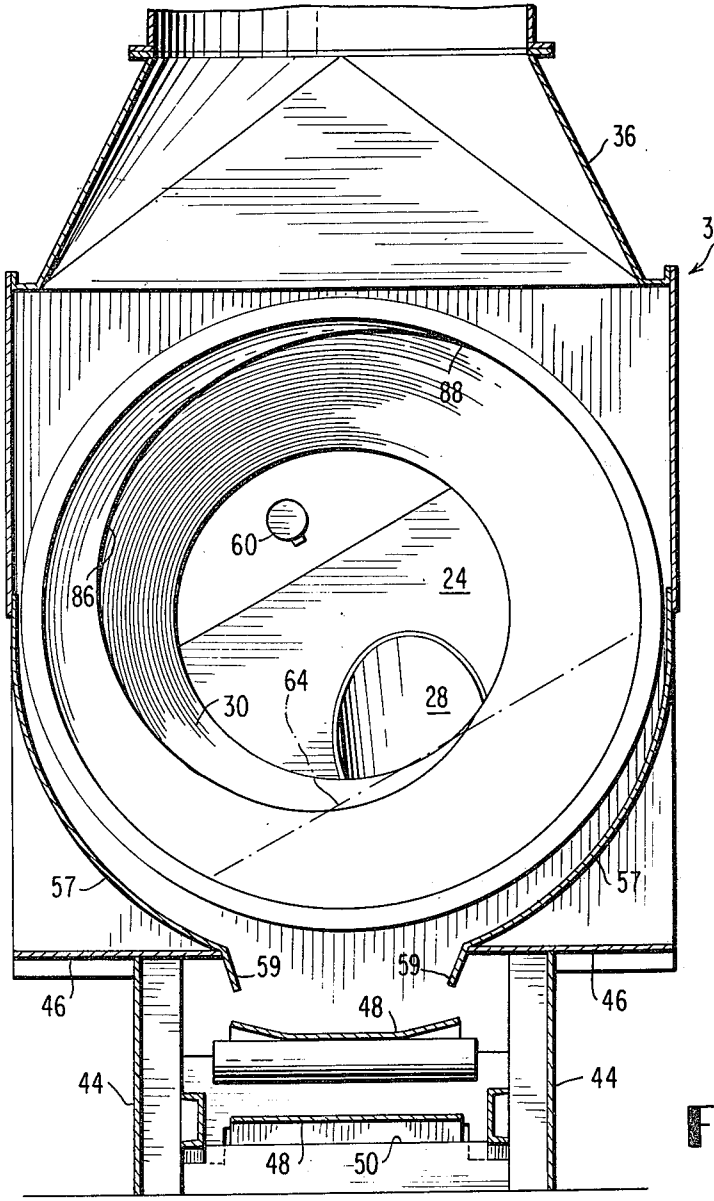
FIG. 8 is a view in section taken on the line 8—8 of FIG. 6.
Figure 6:
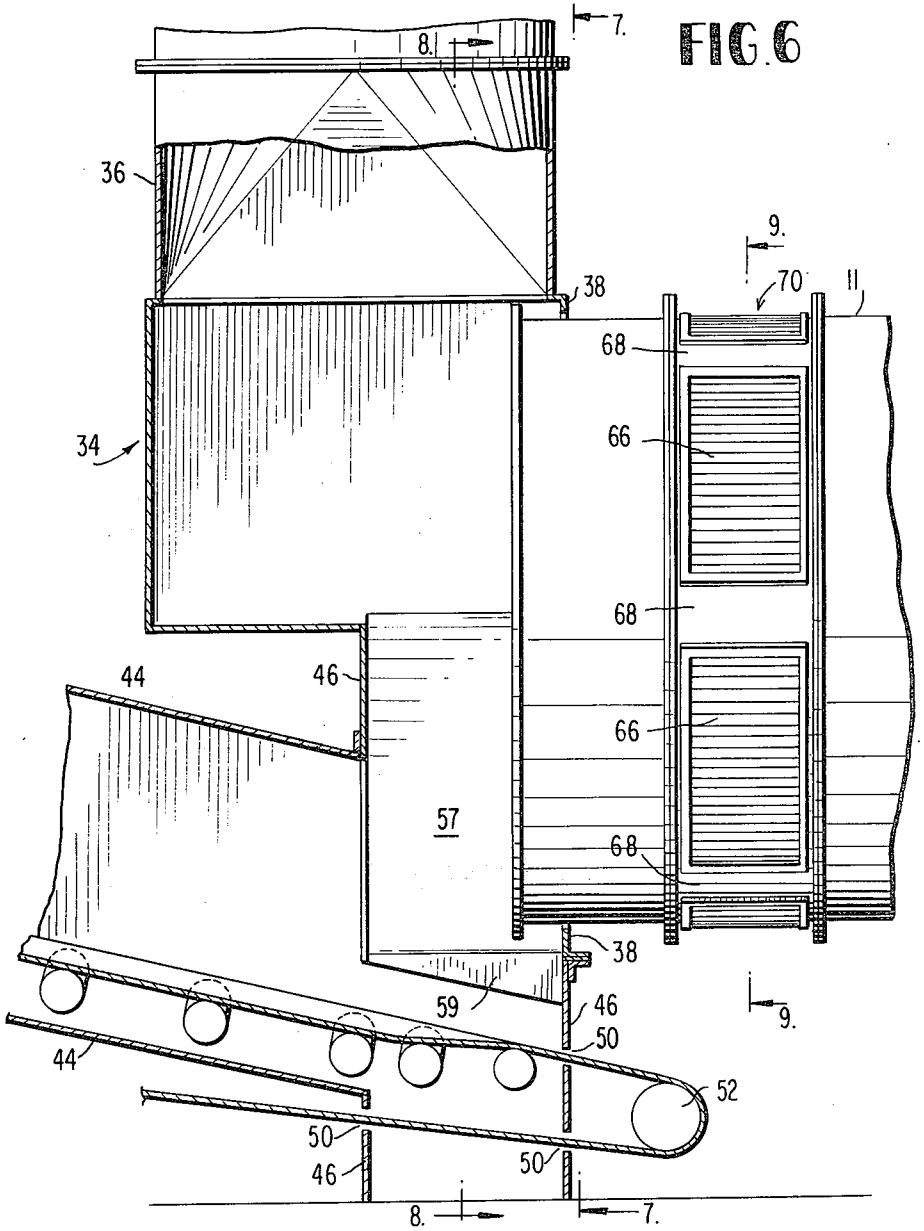
FIG. 6 is a fragmentary, enlarged view, with parts broken away better to show the invention, of the coke delivery end of the apparatus of FIG. 1.
Figure 7:
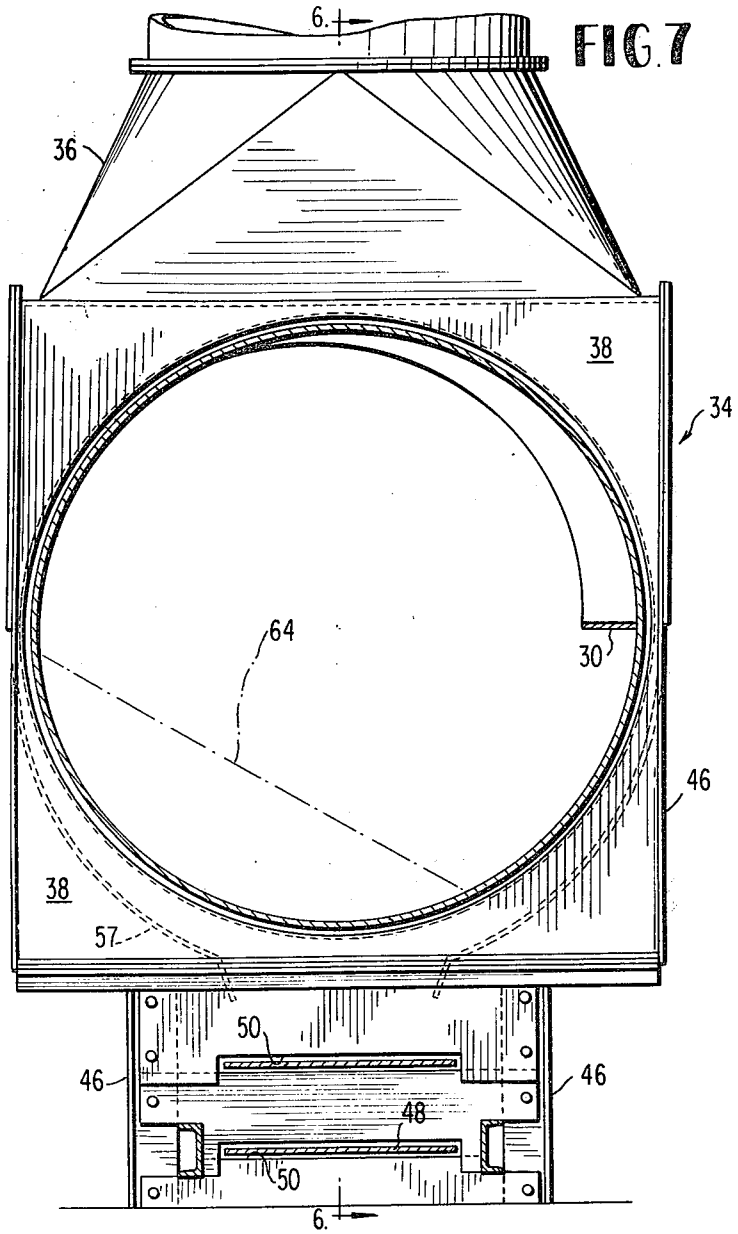
FIG. 7 is a view in section taken on the line 7—7 of FIG. 6.

As best shown in FIGS. 6, 7 and 8, the discharge end of the drum overhangs a semicylindrical portion 57 of lower portion 46 of hood 34 and a pair of guides 59 are set in position to direct the coke discharged from the drum onto conveyor belt 48.

At the coke entry end of drum 11 a water conduit 60 enters and extends 6 to 8 feet into the drum, this conduit being provided with a plurality of spray nozzles 62 for spraying water on the coke. During movement of the coke through the drum, the coke will assume a position indicated by the dotted line 64 and as shown in FIG. 8 the nozzle direct the sprays of water in a direction to impinge the water upon the exposed surface of the coke.

Adjacent the coke delivery end of drum 11, provision is made for escape of excess quenching water. As best shown in FIGS. 6 and 9, openings 66 are formed in the walls 68 of the drum for this purpose and screens indicated generally at 70 are inserted in openings 66. Screens 70 are of the self cleaning type in which slender bars 72, closely spaced and extending longitudinally of the axis of symmetry of the drum form the screens. Each bar has in cross section an equilateral triangular shape with an apex of the triangle pointing away from the interior of the drum whereby particles of coke which can pass through the openings between bars will not become lodged between bars. Supported on legs 75 below screens 70 is a water collection trough 76 with a drain 78 which is connected at 80 to any suitable system for treating the water to remove coke fines before the water is recirculated to conduit 60.

The coke restraining means shown is in the form of an end partition 24, the marginal portions of which are in closely spaced relation to the interior wall of the drum throughout that portion of the drum occupied by the coke as the coke leaves opening 28 of spout 22 and is moved by the helical vane means. The size and shape of the coke restraining means is designed to leave open space between partition 24 and the interior wall of the drum above the highest point the coke reaches in the drum, through which open space the exhaust means 34 will draw air to sweep steam into hood 34.

At the coke entry end of the drum, the depth dimension of the leading portion of the vane in the direction of movement of the vane is gradually decreased as shown best at 82 in FIG. 5 through about three-quarters of the first convolution of the vane. The length of the resulting taper in the vane is not critical and can be more or less than three-quarters of a revolution. At the leading point 84 of the vane, the vane has a depth such that its inner free edge is in the neighborhood of the lowermost point of opening 28 of spout 22 or lower than that point. This prevents the portion of the vane coming closest to the spout during rotation of the drum from crushing the coke entering the drum back against the spout as this portion of the vane passes the spout position.

As best shown in FIG. 8 at 86, the depth dimension of the trailing portion of vane 30 relative to movement of the vane is gradually decreased in the direction opposite to movement of the vane through about three-quarters, more or less, of the final convolution of the vane, with the depth dimension substantially disappearing at the final trailing point 88 of the vane. This arrangement brings about a substantially uniform rate of discharge of the coke from the drum onto conveyor 48, rather than an objectionable periodic surge of coke out of the discharge end of the drum, which would take place each time the trailing end of the vane, if at full depth, would make a revolution.

The system of the preferred embodiment achieves an efficient and smooth coke quenching and cooling operation. As an example of a satisfactory preferred embodiment, the drum can be 20 feet long, have an internal diameter of about 8 feet, with the vane having a depth dimension of about 2 feet measured from the internal surface of the drum to the free edge of the vane. The pitch of the vane can be such as to give about 10 convolutions of the vane over the length of the drum. Sufficient water is sprayed on the coke in the first 6 to 8 feet of the drum so that the coke issuing from the drum is quenched and cooled without excess moisture remaining in the coke. The action of the vane at a drum rotational speed between 3½ and 7 revolutions per minute results in the coke being fed from hopper 12 through spout 22 into the drum and through the drum at a rate such that satisfactory quenching and cooling takes place due to the impingement of the water sprays on the constantly changing surface of the coke as it is moved through the drum by the vane.

With the drum rotating at between 3½ and 7 revolutions per minute, 1,000 to 1,500 cubic feet of coke dumped into hopper 12 from the transfer car can be passed through the quenching and cooling operation to obtain cooled coke of desired moisture content which has not been subject to undue attrition in the drum. Preferably, the illustrated drum is not operated at a speed in excess of about 7 revolutions per minute and the preferred speed with the higher coke quantities appears to be about 6 revolutions per minute.

With the 20-foot long, 8-foot diameter drum, 2-foot deep helical vane having a pitch of 10 convolutions in 20 feet, and with spout 22 being about 2 feet in diameter and positioned as shown, a drum rotational speed of about 6 revolutions per minute will pass about 1500 tons of coke through the drum with the inclined surface of the coke in the drum about tangent to the internal edge of vane 30, as indicated by dotted line 64, in a period of time within which this quantity of coke will be quenched and cooled in a satisfactory manner. Of course, the drum can have a greater or smaller diameter, the vane a greater or less depth and a greater or less pitch with the speed of rotation being varied according to the above principles. In respect to the 1500 tons of coke, a drum of greater diameter with a helical vane of greater depth and the same pitch could utilize a larger spount and rotate at a lower speed to accomplish the desired purposes and where attrition of the coke during processing might be a factor, the larger diameter slower rotating drum would be especially desirable.

Having described the preferred embodiment of my invention, I claim and novel inventive concepts described in the appended claims:

1. Apparatus for quenching and cooling coke comprising a. a rotary drum for receiving hot coke having a cylindrical interior wall, a coke entry end and a coke discharge end, b. means for supporting the drum for rotation about a substantially horizontal axis coinciding with the axis of symmetry of the drum, c. a stationary coke restraining means having lower marginal portions disposed in closely spaced relation to the lower portion of the interior wall of the drum at the coke entry end of the drum to prevent escape of entering coke, the spacing between the coke restraining means and the upper portion of the interior wall of the drum at the entry end of the drum being greater for ingress of sweeping air into the drum, d. hot coke feeding spout means having a coke delivery portion positioned to feed hot coke into the coke entry end of the drum at the lowermost portion of the drum, e. conveyor means at the coke delivery end of the drum for conveying cooled coke away from the drum, f. rigid helical vane means having an inner free edge and an outer edge contiguous to and fixed relative to the interior surface of the drum and extending from the coke entry end of the drum to the coke delivery end of the drum, the axis of symmetry of the helix coinciding with the axis of symmetry of the drum, (1) the diameter and length of the drum, (2) the depth dimension of the vane means and (3) the pitch of the helix all being such as to convey a predetermined amount of coke from the coke entry end of the drum to the coke delivery end of the drum in the time period required to quench and cool the coke with the drum rotating at a speed which will not cause undue attrition of the coke, g. spray means for spraying water on the coke adjacent the coke entry end of the drum, h. screen means associated with the wall of the drum adjacent the coke delivery end of the drum for draining excess water from the drum, i. hood means surrounding and closing the coke delivery end of the drum, j. enclosure means associated with hood means (i) for enclosing conveyors means (e) for minimizing the entry of air into hood means (i) at conveyor means (e), and k. exhaust means associated with hood means (i) for exhausting steam from the drum.

2. The apparatus of claim 1 in which

1. the coke feeding spout means are arranged to feed coke into the drum with a component of motion of the coke in the direction of rotation of the drum.

3. The apparatus of claim 2 in which m. the vane means gradually increase in depth through the major portion of the initial convolution of the helix in the direction of coke movement from a depth about level with the lowermost portion of the delivery end of the coke feeding spout means to the full depth of the vane.

4. The apparatus of claim 3 in which n. the vane means gradually decrease in depth through the major portion of the final convolution of the helix in the direction of coke movement from a full depth to substantially no depth at the coke delivery end of the drum.

5. The apparatus of claim 4 in which o. the coke feeding spout means carry the coke restraining means.

6. The apparatus of claim 1 in which

1. the vane means gradually increase in depth through the major portion of the initial convolution of the helix in the direction of coke movement from a depth about level with the lowermost portion of the delivery end of the coke feeding spout means to the full depth of the vane.

7. The apparatus of claim 6 in which m. the vane means gradually decrease in depth through the major portion of the final convolution of the helix in the direction of coke movement from a full depth to substantially no depth at the coke delivery end of the drum.

8. The apparatus of claim 8 in which n. the coke feeding spout means carry the coke restraining means.

9. The apparatus of claim 1 in which

1. the vane means gradually decrease in depth through the major portion of the final convolution of the helix in the direction of coke movement from a full depth to substantially no depth at the coke delivery end of the drum.

10. The apparatus of claim 9 in which m. the coke feeding spout means carry the coke restraining means.

11. The apparatus of claim 1 in which

1. the coke feeding spout means carry the coke restraining means.

12. The apparatus of claim 2 in which m. the vane means gradually decreases in depth through the major portion of the final convolution of the helix in the direction of coke movement from a full depth to substantially no depth at the coke delivery end of the drum.

13. The apparatus of claim 12 in which n. the coke feeding spout means carry the coke restraining means.

* * * * *

UNITED STATES PATENT OFFICE

CERTIFICATE OF CORRECTION

Patent No. 4,010,081 Dated March 1, 1977

Inventor(s) JUDSON W. MARTT

It is certified that error appears in the above-identified patent and that said Letters Patent are hereby corrected as shown below:

Column 1, line 39, "ia" should read -- is --;

Column 2, line 14, between "14, 14" and "mounted", insert -- are --;

line 17, "reduce" should read -- reducer --;

line 47, "and" should read -- an --;

Column 3, line 4, "of" (second occurrence) should read --on--;

line 23, "nozzle" should read -- nozzles --;

Column 4, line 65, "and" should read -- the --;

Column 6, line 30, "claim 8" should read -- claim 7 --.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*